United States Patent [19]

Gendala

[11] Patent Number: 4,621,383

[45] Date of Patent: Nov. 11, 1986

[54] METHOD AND APPARATUS FOR INFLATING AN ARTICLE

[76] Inventor: Christopher Gendala, 24 Broadway, Elwood, Victoria, 3184, Australia

[21] Appl. No.: 699,433

[22] Filed: Feb. 7, 1985

[30] Foreign Application Priority Data

Feb. 9, 1984 [AU] Australia ..... PG3545
May 1, 1984 [AU] Australia ..... PG4777

[51] Int. Cl.[4] ..... F17C 5/00
[52] U.S. Cl. ..... 5/454; 441/41
[58] Field of Search ..... 5/453, 454; 417/53, 417/474, 478; 441/41, 40

[56] References Cited

U.S. PATENT DOCUMENTS

| | | | |
|---|---|---|---|
| 918,391 | 4/1909 | Taarud | 5/454 X |
| 1,944,466 | 1/1934 | Rubin | 5/454 |
| 2,369,736 | 2/1945 | Hurt | 5/454 |
| 4,521,166 | 6/1985 | Phillips | 5/454 X |

FOREIGN PATENT DOCUMENTS

| | | | |
|---|---|---|---|
| 2257424 | 5/1973 | Fed. Rep. of Germany | 441/41 |

*Primary Examiner*—John E. Murtagh
*Assistant Examiner*—Richard Chilcot
*Attorney, Agent, or Firm*—Finnegan, Henderson, Farabow, Garrett & Garrett

[57] ABSTRACT

This invention relates to an inflatable article such as an air bed or the like and includes a deformable bag 12 which is coupled to the air bed 10 via a stem 18. The deformable bag is opened to allow air to enter the bag and is then deformed to force air from the bag 12 into the article 10 to inflate the article. The bag in the deformed condition forms a valve for preventing excape of air from the bed 10 and may be inserted into a pouch 20 provided on the bed 10. The invention may also include a chamber 60 disposed between the bag 12 and the air bed 10 for enabling the bed 10 to be inflated to a relatively high pressure. A first valve 64 is provided between the chamber and the bag 12 and the open condition allows air to pass from the bag 12 into the chamber 60. A second valve 62 is provided which opens upon deformation of the chamber 60 to allow air to pass from the chamber 60 into the air bed 10.

6 Claims, 9 Drawing Figures

METHOD AND APPARATUS FOR INFLATING AN ARTICLE

This invention relates to a method and apparatus for inflating an article, such as an air bed or a small raft or the like.

Conventionally such articles are inflated by means of a pump or by the user blowing them up. These conventional methods are time consuming and require quite a deal of effort on the part of the user.

The object of this invention is to provide a simpler method and apparatus for inflating an article.

The invention resides in an inflatable article having a deformable member having an opening therein for allowing air to enter the member, said member being coupled to the article by a stem located between the article and deformable member such that when the member is deformed fluid is forced from the member into the article via the stem to inflate the article.

The invention may also be said to reside in an inflatable article having a deformable member for inflating the article, said deformable member having an opening for allowing fluid to enter the member and being coupled to the article such that when the member is deformed air is forced into the article to inflate the article and deformation of the member forms a valve member to prevent deflation of the article.

The invention may still further be said to reside in a method of inflating an article, said method comprising the steps of providing a deformable member in communication with the article, allowing the member to at least partly fill with fluid and deforming the member to force air into the article to inflate the article.

Accordingly since it is only necessary to allow a deformable member to at least partly fill with air and to then deform the member, such as by folding or squeezing it into a ball or roll, an inflatable article can be inflated and maintained in the inflated condition with minimal effort and minimal time delay.

Preferably the deformable member comprises a bag formed of airtight material which is completely open at one end. The bag is deformed by closing the open end and rolling the bag into a roll to force the air from the bag into the article.

Preferably the article includes a pouch into which the rolled bag may be located, the pouch being in close proximity to the inflatable article such that the article when inflated presses against the pouch so that the rolled up bag when located therein is securely maintained in the rolled up condition to prevent deflation of the article. The rolled up bag therefore acts as a one way valve to prevent deflation of the bag. In an alternative embodiment the pouch could be made small so that the size of the pouch is sufficient to maintain the bag in the rolled up condition. Furthermore it would also be possible to simply use a tie or the like to surround the bag to maintain it in the rolled up condition, in place of the pouch.

A preferred embodiment of the invention will be described with reference to the accompanying drawings which illustrate the preferred embodiments of the invention applied to an air bed.

Figure 1:
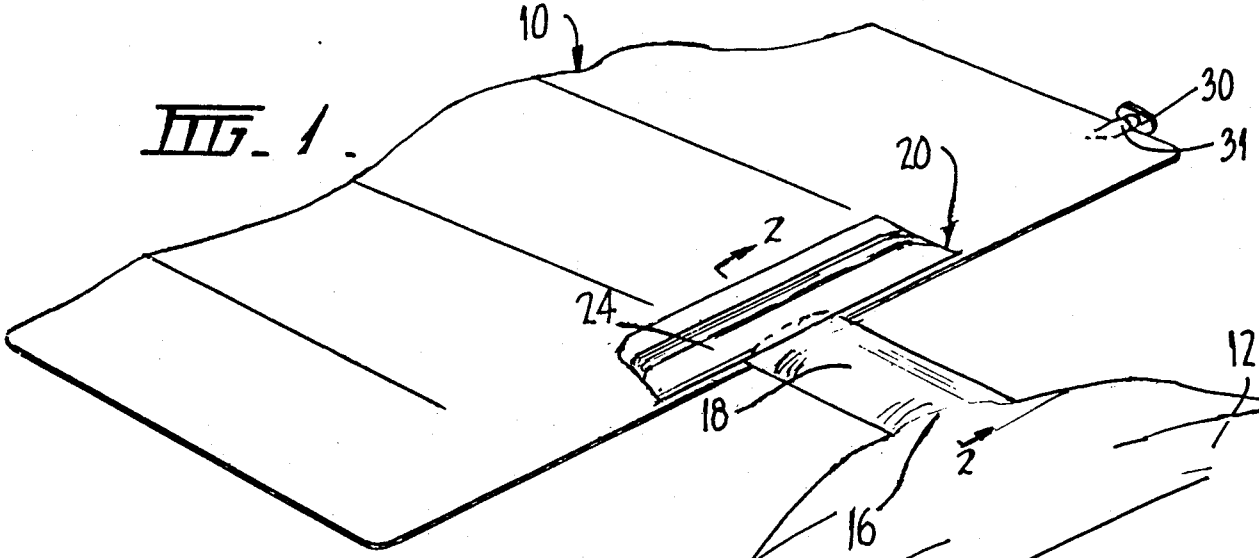
FIG. 1 is a perspective view of an air bed embodying the present invention.
Figure 2:
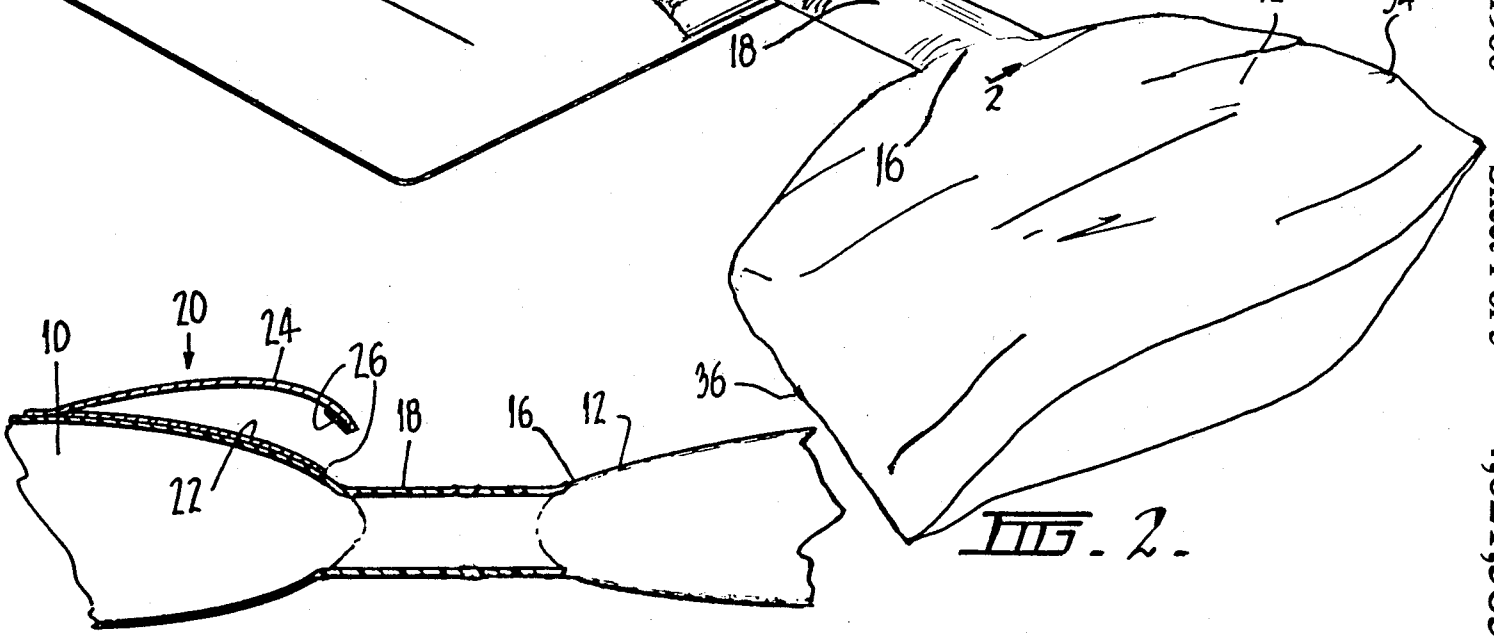
FIG. 2 is a view along the line 2—2 in FIG. 1.

With reference to FIG. 1 an air bed 10 is shown which may be of any desired configuration. The air bed 10 has a deformable bag 12 coupled thereon. The bag 12 has an open end 14 with the other end 16 of the bag being securely coupled to the air bed 10 via a stem 18 such that the interior of the bag 12 is in communication with the interior of the air bed 10 via the stem 18. The stem 18 is of length 30 cm to 45 cm and width 20 cm.

The end of the air bed 10 adjacent the bag 12 is provided with a pouch 20 which has an inner wall 22 and an outer wall 24. Preferably the pouch 20 is located on the top surface of the air bed 10. However it could be provided on the bottom surface if desired.

Figure 5:
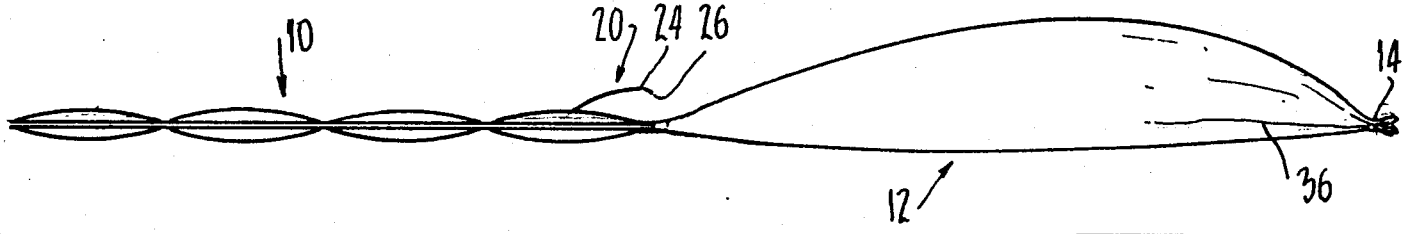
FIGS. 5, 6 and 7 show a bag used in the embodiments of FIGS. 1 to 4 being deformed.
Figure 6:
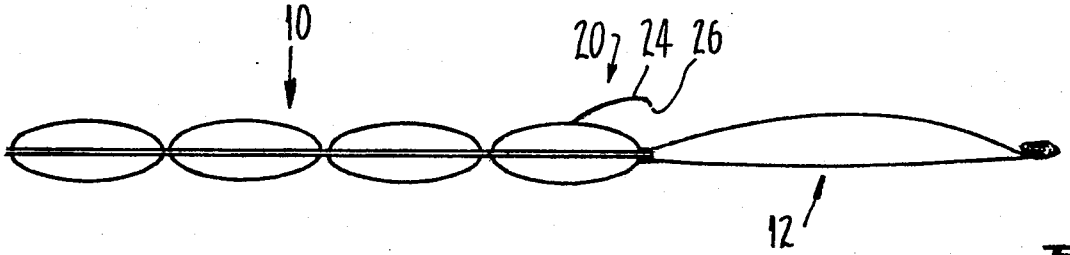
Figure 7:
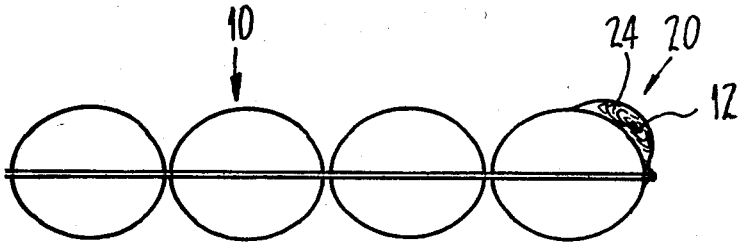

In order to inflate the air bed 10 a plug or plugs 30 are secured in place and the bag 12 is opened by the user to allow air to enter through the open end 14. The open end 14 is then closed as shown in FIG. 5 by simply drawing the open end into a ball with the hands to trap air inside the bag 12. The outer extremities 34 and 36 of the bag shown in FIG. 1 are folded inwardly as the bag is rolled up to thereby force air from the bag into the air bed 10. As shown in FIG. 6 the bag is continued to be rolled into a roll thereby forcing all the air from the bag into the article 10 to inflate the article. Once the bag 12 has been completely rolled up and the air bed 10 is inflated, the rolled up bag 12 and the stem 18 is located in the pouch 20 as shown in FIG. 7. The air pressure inside the air bed 10 and the outer wall 24 of the pouch 20 maintains the bag 12 in the rolled up condition so that the rolled up bag 12 and stem 18 act as a valve to prevent the air from escaping from the air bed 10. In an alternative embodiment the pouch may be made small so that the mere size of the pouch maintains the bag 12 in the rolled up condition or a tie, such as a length of string, may be used to secure the bag and stem 18 in the rolled up condition. In this regard it is therefore desired to make the pouch 20 as tight a fit for the rolled up bag 12 and stem 18 as possible so that the bag is maintained at a very tightly rolled up condition to prevent the air from leaking therefrom.

It is preferred that the bag be of sufficient size so that it is only necessary to roll the bag up once in order to completely inflate the article. However if it is not convenient to provide a bag of sufficient size to inflate the article by rolling the bag up once, the bag 12 may be unrolled and opened to allow air to enter the bag and the bag deformed in the manner described above to force more air into the article. This procedure may be repeated as many times as necessary. Generally with air beds much of the air already forced into the air bed 10 will remain therein. However if the article is of such a nature as air may escape when the bag 14 is unrolled the article may be sealed by simply applying pressure to the region where the bag 12 joins the article to tramp the air, already in the article, within the article.

A zip 26 or other closure means such as velcro fasteners, buttons or faststuds, may be provided between the outer portion 24 of the pouch 20 and the bottom end portion of the air bed 10 to close the pouch 20. However it should be understood that the pouch 20 could merely be left open.

Figure 3:
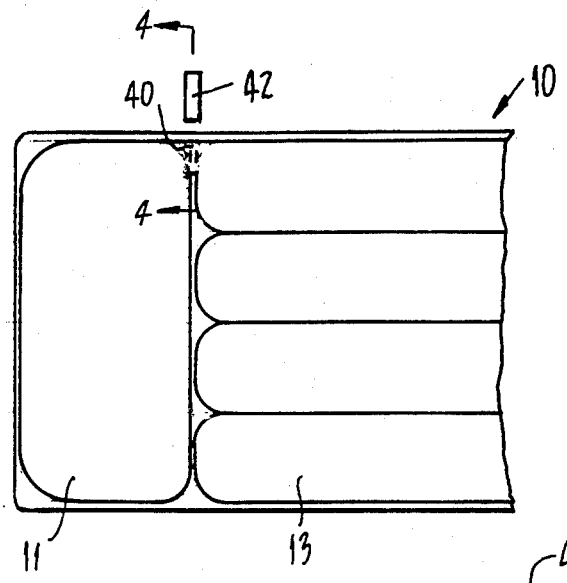
FIG. 3 is a view of an air bed having two compartments which are to be maintained at different pressures.
Figure 4:
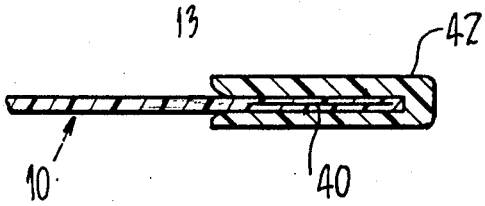
FIG. 4 is a view along the line 4—4 of FIG. 3 with a clip located in place to seal the two compartments.

In FIG. 3 and FIG. 4 the air bed 10 is shown having a pillow portion 11 and a main portion 13. As is known it is desirable to provide the pillow portion 11 and the main portion 13 separated so that when a person lies on the main portion 13 air is not forced into the pillow portion 11 to increase the size of the pillow portion 11 and therefore make it uncomfortable for a user to lie on. In order to inflate both the main portion 13 and the pillow portion 11 with the apparatus of the invention a passageway 40 is provided between the main portion 13 and the pillow portion 11. Once the air bed 10 has been inflated a peg 42 is forced over the passage 40 to close the passage and prevent air from being forced from the main portion 13 into the pillow 11 and vice-versa.

As best seen in FIG. 4 the peg 42 is of U-shaped cross-section and squeezes the upper and lower surface of the air bed 10 together to close off the passage 40 (which is shown slightly opened in FIG. 4 for purposes of illustration). Therefore the main portion 13 and pillow 11 may be inflated in the same operation and the pillow portion 11 sealed from the main portion 13 so as to maintain the desired air pressure in both portions.

To deflate the article the plug 30 is simply removed and the air bed rolled up from the pillow end 11 thereby forcing the air out of the plug hole 31. The rolled up bag 12 may be maintained in the rolled up condition in the pouch 20 during deflation and storage of the air bed 10. The plug 30 may also be used to allow some air to escape from the air bed if the air bed is over inflated by the bag 12.

The bag 18 is preferably made from a non porous reinforced plastics material. For example the bag can be a plastics bag impregnated with nylon thread or a woven nylon bag impregnated with plastics material.

The provision of the stem 18 allows air which remains in the stem to be forced into the article with ease and without damage to the bag or stem by rolling the bag together with the stem. The stem 18 is made from the same material as the article which is stronger than that of the bag. The stem 18 also protects the bag when it is rolled up since the stem 18 is rolled about the outside of the bag in the fully rolled up state. The stem 18 also prevents damage to the bag when the stem and bag are rolled up, due to any back pressure which may be forced into the stem from the article if the article is pressurized from the outside.

Figure 8:
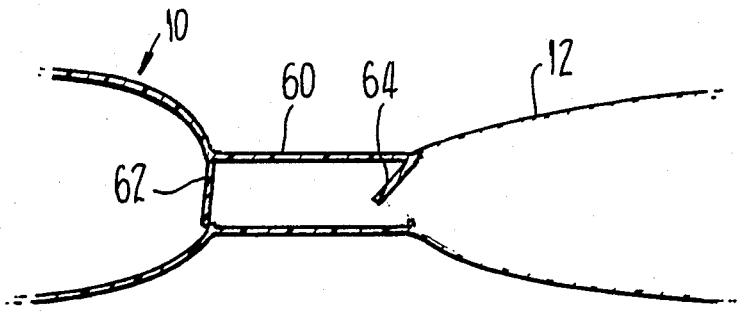
FIGS. 8 and 9 show an embodiment for applying high pressure to an article.
Figure 9:
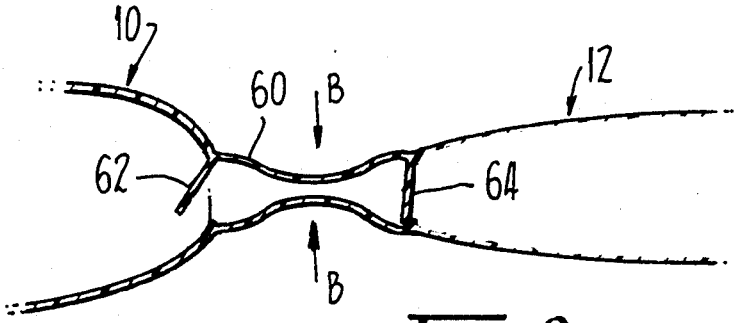

In some environments it may be necessary to apply a relatively high pressure to an article which is greater than can be applied directly by the bag 12. FIGS. 8 and 9 show an embodiment for applying high pressure air to an article such as an air bed 10 wherein a stem 60 is provided between the bed 10 and the bag 12. The stem 60 is preferably of length between 30 cm and 45 cm. The stem 60 is provided with one way flap valves 62 and 64 at its ends. In order to pressure the bed 10 air is forced from bag 12, in the manner described above, into stem 60 with the pressure of the air opening valve 64. The pressure in the bed 10 maintains valve 62 closed. Once the stem 60 is full of air the bag is released and valve 64 closes. Pressure is then applied to stem 60 as shown by arrows B which forces the valve 62 to open and air to pass into the bed 10. When pressure is removed from the stem 60 the valve 62 closes to prevent escape of air from the bed 10. The above operation is repeated until the desired pressure is applied to the bed 10.

Preferably the stem 60 is made from the same material as the bed so that it is not damaged by high pressure air. This embodiment prevents damage to bag 12 which might otherwise occur in attempting to apply a high pressure to the bed 10 direct from the bag 12.

It should be noted that the construction of FIGS. 8 and 9 can be included in the article disclosed in FIGS. 1 to 7.

The preferred embodiments of the present invention thereby provide a simple and efficient method and apparatus for inflating an article. In this respect the bag can be rolled up by a user very quickly and with minimal effort thereby decreasing the time and effort required to inflate an article.

Notwithstanding the fact that the rolled up bag 12 located in the pouch 20 forms a valve to prevent air from escaping from the air bed 10, a one way flap valve or the like could be included within the stem 18 to ensure sealing of the air bed.

Since modifications within the spirit and scope of the invention may readily be effected by persons skilled within the art, it is to be understood that this application is not limited to the particular embodiment described by way of example hereinabove.

The claims defining the invention are as follows.

I claim:

1. An inflatable article having a deformable member having an opening therein for allowing air to enter the member, said member being coupled to the article by a stem located between the article and deformable member such that when the member is deformed fluid is forced from the member into the article via the stem to inflate the article wherein said stem is made from a material which is stronger than the material from which the deformable member is made, said stronger material allowing the stem to be deformed such that said deformable member can be rolled up and said stem rolled about said deformable member to protect the deformable member.

2. An inflatable article according to claim 1 wherein deformation of the member forms a valve member to prevent deflation of the article.

3. The inflatable article of claim 1 wherein the deformable member is a bag open at one end and coupled to the article at the other end.

4. The article of claim 3 wherein a pouch is provided in which the bag, when deformed, may be located, the pouch being in close proximity to the inflatable article such that the article when inflated presses against the pouch so that the rolled up bag, when located therein, is securely maintained in the rolled up condition thereby forming said valve to prevent deflation of the article.

5. An inflatable article according to claim 1 wherein said stem has a first valve means which in an open position allows fluid to enter the chamber from the deformable member and which in a closed position prevents air from escaping from the stem into the deformable member, said stem having a second valve means for allowing fluid to pass from the stem into the article upon deformation of the stem and for preventing fluid from escaping from the article into the stem.

6. An article according to claim 5 wherein deformation of the stem causes the first valve means to close tightly to prevent escape of air from the stem into the deformable member and causes the second valve means to open to allow the fluid to pass into the inflatable article such that the article can be inflated to a high pressure.

* * * * *